US009775419B2

(12) United States Patent
Genain et al.

(10) Patent No.: US 9,775,419 B2
(45) Date of Patent: Oct. 3, 2017

(54) HAIR TREATMENT METHOD

(75) Inventors: Gilles Genain, Paris (FR); Gabin Vic, Semoy (FR); Stefania Nuzzo, Paris (FR); Marie Muller, Paris (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 13/697,281

(22) PCT Filed: May 11, 2011

(86) PCT No.: PCT/IB2011/052074
§ 371 (c)(1),
(2), (4) Date: Feb. 20, 2013

(87) PCT Pub. No.: WO2011/141882
PCT Pub. Date: Nov. 17, 2011

(65) Prior Publication Data

US 2013/0152959 A1 Jun. 20, 2013

Related U.S. Application Data

(60) Provisional application No. 61/348,782, filed on May 27, 2010.

(30) Foreign Application Priority Data

May 11, 2010 (FR) ..... 10 53701

(51) Int. Cl.
*A45D 7/02* (2006.01)
*A45D 7/06* (2006.01)
(Continued)

(52) U.S. Cl.
CPC ..... *A45D 7/06* (2013.01); *A45D 1/04* (2013.01); *A45D 2/001* (2013.01); *A45D 2001/008* (2013.01); *A45D 2200/207* (2013.01)

(58) Field of Classification Search
CPC ..... A45D 7/00; A45D 2007/001; A45D 2007/002; A45D 2007/004;
(Continued)

(56) References Cited

U.S. PATENT DOCUMENTS 3,958,340 A * 5/1976 Meyers ..... F26B 3/343 34/103
4,877,042 A * 10/1989 Downey ..... 132/212
(Continued)

FOREIGN PATENT DOCUMENTS

DE 31 48 538 6/1983
DE 10119204 A1 * 10/2002
(Continued)

OTHER PUBLICATIONS

French Search Report Issued Dec. 2, 2010 in Application No. FR 1053701 Filed May 11, 2010.
(Continued)

*Primary Examiner* — Robyn Doan
(74) *Attorney, Agent, or Firm* — Oblon, McClelland, Maier & Neustadt, L.L.P.

(57) ABSTRACT

The present invention relates to a cosmetic hair treatment method comprising at least the steps consisting of: a) applying a mechanical tension to said hair, b) exposing said hair under mechanical tension to microwaves, in the presence of a solvent in vapor form in contact with said hair, without complete drying of the hair during microwave exposure, the solvent in vapor form being entirely generated by the evaporation of a compound which is present, before emission of the microwaves, in contact with the treated hair.

21 Claims, 3 Drawing Sheets

(51) Int. Cl.
*A45D 1/04* (2006.01)
*A45D 2/00* (2006.01)
*A45D 1/00* (2006.01)

(58) Field of Classification Search
CPC ..... A45D 2007/005; A45D 2007/008; A45D 7/02; A45D 7/04; A45D 7/045; A45D 7/06; A45D 7/065; A45D 1/04; A45D 2/001
USPC ..... 132/200, 207, 206, 211, 203; 219/678
See application file for complete search history.

(56) References Cited

U.S. PATENT DOCUMENTS

| | | | | |
|---|---|---|---|---|
| 5,058,609 | A | 10/1991 | Sandoz et al. | |
| 5,584,308 | A * | 12/1996 | Maekawa | 132/203 |
| 5,989,534 | A * | 11/1999 | Samain | 424/70.51 |
| 6,026,821 | A * | 2/2000 | Last | 132/200 |
| 2003/0213071 | A1 | 11/2003 | Sauter et al. | |
| 2005/0229336 | A1* | 10/2005 | Fondin | A61K 8/23 8/405 |
| 2006/0108358 | A1 | 5/2006 | Bell | |
| 2007/0056960 | A1 | 3/2007 | Bell | |
| 2008/0011315 | A1* | 1/2008 | Schreiber et al. | 132/210 |
| 2008/0142033 | A1* | 6/2008 | Sabbagh | A61K 8/20 132/204 |
| 2010/0006116 | A1 | 1/2010 | Bell | |
| 2012/0141690 | A1* | 6/2012 | Takahashi | A61Q 5/04 427/544 |

FOREIGN PATENT DOCUMENTS

| | | |
|---|---|---|
| FR | 2 114 540 | 6/1972 |
| FR | 2 118 945 | 8/1972 |
| JP | S56-28526 | 8/1981 |
| JP | S59-80206 | 5/1984 |
| JP | 2987606 | 12/1999 |
| JP | 2004-262798 | 9/2004 |
| JP | 2005-253947 | 9/2005 |
| JP | 2009-136367 | 6/2009 |

OTHER PUBLICATIONS

International Search Report Issued Jul. 29, 2011 in PCT/IB11/52074 Filed Nov. 5, 2011.
Office Action issued Feb. 19, 2015 in co-pending Japanese Patent Application No. 2013-509651 filed Jul. 4, 2013, with computer-generated English translation.

* cited by examiner

Fig.1
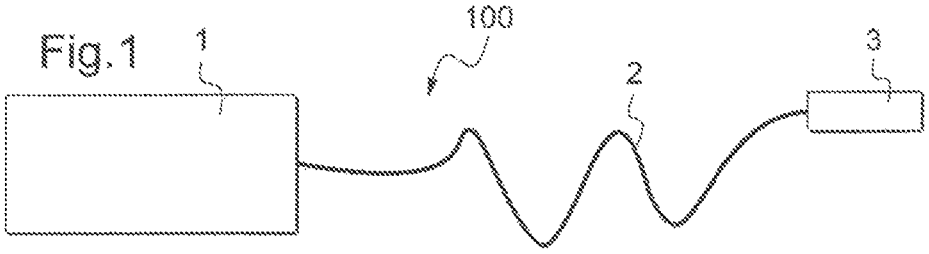
Fig.2
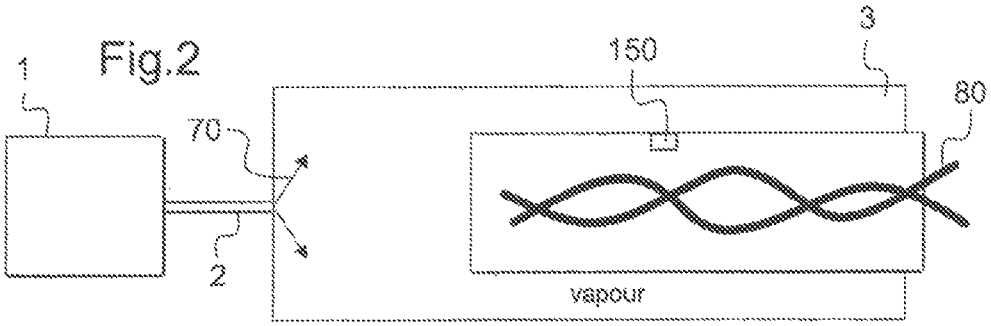
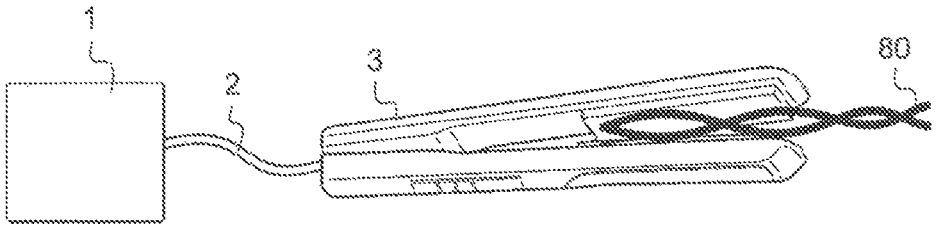
Fig.3
Fig.4
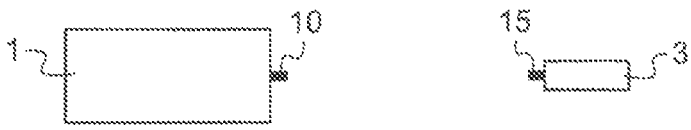
Fig.5
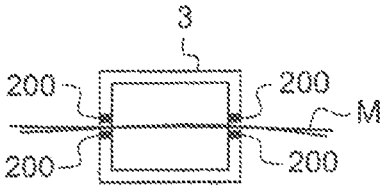
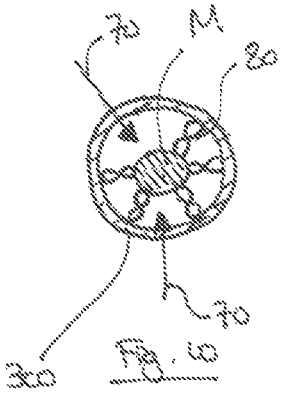
Fig. 6

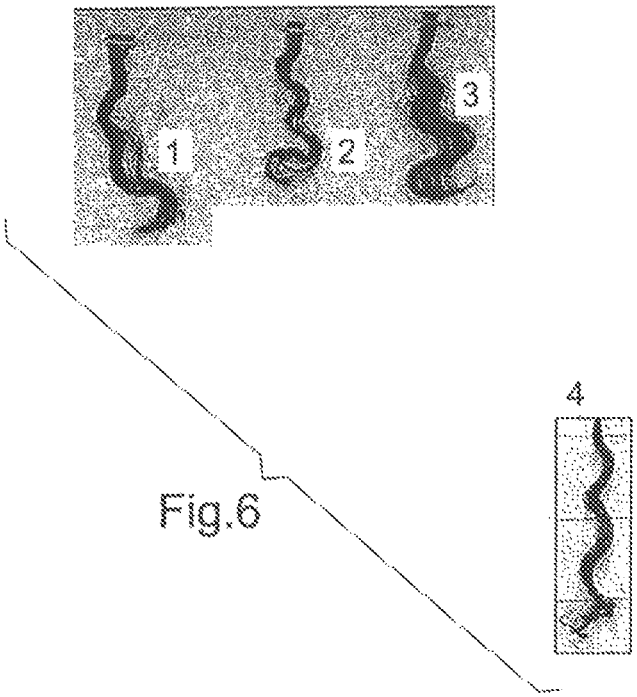
Fig.6
Fig.7
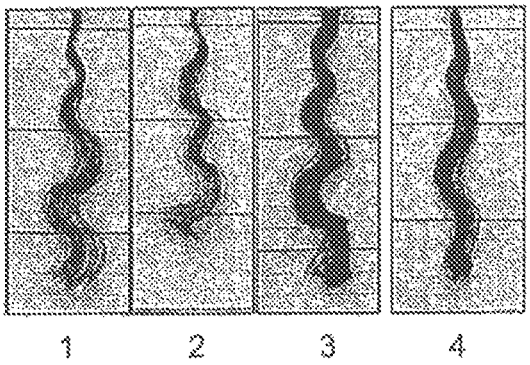

HAIR TREATMENT METHOD

This application is a 371 of PCT/IB2011/052074 filed May 11, 2011, and claims benefit of U.S. provisional application Ser. No. 61/348,782, filed May 27, 2010. Priority to French patent application 1053701, filed May 11, 2010, is claimed.

The present invention relates to hair treatment methods.

BACKGROUND

Cosmetic treatments for durable shaping of the hair are primarily carried out using chemical products.

Two techniques, both based on the breaking of the —S—S— disulphide bonds present in the keratin (cystine), are generally used for producing permanent shaping of the hair.

The first technique comprises a first step which involves opening the disulphide bonds using a composition comprising a reducing agent, for example of thioglycolic acid type. This first reducing step is generally conducted at a pH of between 8 and 9.

This first technique then comprises, preferably after rinsing of the hair, a second step which involves reconstituting the disulphide bonds by applying an oxidizing composition, referred to as a fixer, to the hair. Prior to the application of the reducing composition, the hair may be placed under tension by suitable devices such as rollers, or may be smoothed out. The oxidizing step may be conducted at a pH of approximately 3 and may facilitate the formation of new disulphide bridges, allowing the head of hair to be held in the desired shape.

The second technique comprises a step of lanthionization, employing a composition comprising a base belonging to the class of the hydroxides. The lanthionization step is generally conducted at a basic pH of approximately 13. Lanthionization is the conversion of the disulphide bridges to monosulphide bridges. This type of treatment is used primarily for the shaping of naturally wavy hair.

In order to obtain satisfactory performance in terms of durability of the shape, the compositions used in the known treatments of the prior art may comprise relatively high concentrations of active chemical agents (reducing agents or hydroxide compounds, for example). Accordingly, for example, thioglycolic acid may be used, in certain compositions, at concentrations by mass of between 6% and 11%, and sodium hydroxide at 2%.

The products containing thioglycolic acid have an unpleasant odour, which may be present during application and which may, in addition, persist on the hair for some time after the treatment has been carried out.

Moreover, the treatments described above may result in irreversible damage to the hair, caused by changes to the intrinsic properties of the hair fibre.

These treatments may also irritate the scalp, owing to their relatively high concentration of active chemical agents.

It is known, furthermore, to supply heat during the treatment in order to activate the processes. These technologies may in effect allow improvement in cosmetic performance, but always involve high concentrations of active chemical agents and may therefore exhibit the same drawbacks as the treatments described above.

Documents WO 2002051281, US 20060042649, US 20040250830, WO 2002100210, US 2000680432, U.S. Pat. No. 6,079,422, U.S. Pat. No. 5,988,182, U.S. Pat. No. 5,819,763, U.S. Pat. No. 5,773,802, U.S. Pat. No. 5,676,871, JP 09075125, JP 09051813, AU 9664467, U.S. Pat. No. 5,494,598, EP 197824, U.S. Pat. No. 4,710,609, U.S. Pat. No. 4,743,726, U.S. Pat. No. 4,952,360, U.S. Pat. No. 5,030,820 and U.S. Pat. No. 5,286,949 describe articles, for example rollers, which may be heated in a household microwave and which are used on wet hair for drying and hairsetting.

U.S. Pat. No. 3,958,340 describes a method for rapid drying of hair pieces, using air heated by microwave radiation.

Patent application US 20070056960 describes a shaping tool which allows locks of wet hair to be curled, smoothed and dried using microwaves.

Patent DE 3148538 describes a cylindrical tool which is protected by a wall and has a lock of hair wound around it. The lock is dried and set using microwaves which are applied to the space between the cylinder and the wall.

FR 2 178 049 discloses devices for delivering electromagnetic energy into various materials.

Moreover, FR 2 114 540 and FR 2 118 945 disclose methods for heating and drying hair by using electromagnetic radiation.

A need exists to provide new, more effective and less aggressive methods for permanent shaping of the hair.

There is an interest in particular in having methods which allow enhanced durable shaping performances to be obtained, while minimizing the impact of chemical products on the hair and the scalp.

There is also a need to have new devices for durable shaping of the hair.

The present invention aims to meet some or all of the aforementioned needs.

According to a first aspect, the present invention provides a cosmetic hair treatment method comprising at least the steps consisting of:

a) applying a mechanical tension to said hair, b) exposing said hair under mechanical tension to microwaves, in the presence of a solvent in vapour form in contact with said hair, without complete drying of the hair during the entire microwave exposure.

In the event of complete drying in step b), the shaping is not obtained.

In step a), the microwave radiation may be already existent or not, and so may be the solvent in vapour form. In other words, steps a) and b) may be successive or simultaneous.

By "mechanical tension applied to said hair" is meant a mechanical tension applied to a portion at least of the length of said hair.

The present invention is able to allow a durable shaping treatment that is less aggressive for the scalp and the hair.

Moreover, the application to the hair of a mechanical tension in the presence of microwaves and a solvent in vapour form is able to allow durable and enhanced shaping of the hair to be obtained even in the absence of reducing agents or alkali metal or alkaline earth metal hydroxides.

By "microwaves" are meant an electromagnetic radiation with a frequency of between 500 MHz and 300 GHz.

The frequency of the microwaves used in step b) is preferably between 500 MHz and 10 GHz, for example from 915 MHz to 2.45 GHz.

The power of the microwaves used in step b) may be less than or equal to 500 W, preferably less than or equal to 200 W. The power may be greater than or equal to 10 W, to 20 W, to 30 W, to 75 W or to 100 W. The power of the microwaves used in step b) is, for example, between 100 and 250 W, or even between 100 and 200 W or between 100 and 175 W.

The microwaves may be generated by a microwave generator, for example a solid-state generator such as a magnetron.

The expression "without complete drying of the hair" signifies that, after step b), the hair is moist to the touch. The hair may therefore retain at least 1%, in particular at least 2%, or even 5%, of the weight of the liquid compounds present, before step b), in contact therewith, these liquid compounds adding to the natural moisture of the hair before treatment.

The application of the mechanical tension may be carried out by a device for applying mechanical tension, this device being able to be configured in order to induce flexure, traction, torsion and/or compression, for example, on the hair. The device for applying mechanical tension may exert mechanical stresses simultaneously on one or more locks of hair.

The mechanical tension device may be, for example, a roller.

The solvent in vapour form is entirely generated by the evaporation of a compound which is present, before emission of the microwaves, in contact with the treated hair.

The treated hair must never be totally dry throughout the duration of action of the microwaves. In other words, the hair must always be impregnated with the solvent during said exposure.

In order to facilitate impregnation, the solvent may be atomized beforehand.

Step b) of the method according to the invention may take place within an enclosure, as may, optionally, step a). The enclosure may form a microwave screen.

During the method according to the invention, especially during step b), the enclosure may contain the hair to be treated and the device for applying a mechanical tension.

By "contain the hair" is meant contain the hair over some or all of its length.

The enclosure may cover the hair over a length, for example, of greater than or equal to 5 cm. Therefore, a length of at least 5 cm of hair may be treated in the enclosure.

The enclosure may be fixed relative to the hair treated during the emission of the microwaves, or may be mobile relative to the hair, being displaced, for example, along the hair to be treated.

The microwaves may be emitted, where appropriate, from an antenna.

As indicated above, the enclosure may be configured so as not to release the solvent in vapour form to the exterior medium, or to release only a small amount thereof, by virtue, for example, of a solvent recycling facility, the recycling taking place, for example, in vapour form or liquid form, after condensation of the solvent.

The enclosure may comprise a material configured to absorb the solvent in vapour form. The enclosure may comprise a cold wall on which the solvent condenses and/or an extraction duct for the solvent in vapour form.

Accordingly, the method according to the invention may comprise, during and/or after step b), a step of recovery of the solvent, for example in vapour form and/or liquid form and/or absorbed on a material.

The enclosure is advantageously substantially impervious to microwaves. In other words, the enclosure may be configured to contain the microwaves emitted. Step b) may therefore take place within an enclosure which is impervious to microwaves.

The enclosure may comprise at least one joint of an electrically conductive material which is, for example, elastically deformable, allowing the microwaves used in step b) to be shielded, while allowing the hair to exit the enclosure if necessary. The joint may comprise, for example, a foam filled with electrically conductive particles, a brush formed of electrically conductive bristles, or a comb comprising metal teeth.

When the enclosure is in the form of a hood, the enclosure may comprise an electromagnetic shielding through which the treated hair is able to pass. Such shielding allows the hair of the user to be treated, while protecting the head of the user from the microwaves emitted.

The electromagnetic shielding may be formed, for example, by a grid or a wire mesh.

The treatment device serving to implement the method may comprise a sound and/or light warning system, for the purpose, for example, of warning the user of an escape of microwaves to the outside of the enclosure and/or of an excessive temperature inside the enclosure. The treatment device advantageously comprises a safety system which prevents the emission of microwaves when the enclosure is not closed and/or in the event of abnormal operation, such as of excessive temperature, for example, and/or in the absence of solvent.

The treatment device may be configured to control the duration for which microwaves are emitted, in order that a duration of treatment likely to damage the hair is not attained.

The method according to the invention may comprise, before step b), a step of detecting the closing of the enclosure. For example, a contactor is activated when the enclosure is closed.

The transmission of the microwaves may be conditioned for the detection of the closing of the enclosure.

The method according to the invention may further comprise a step of detecting the placement of the hair which is to be treated, before step b). This detection step may be carried out, for example, by an optical sensor and/or a mechanical sensor.

The method according to the invention may comprise, during step b) for example, a step of measuring the temperature to which the treated hair is subject. This step of temperature measurement may be carried out by a thermometer without contact with the hair.

The enclosure, when it is defined by a tongs, for example, may include some or all of the device for applying mechanical tension.

The device for applying mechanical tension may comprise one or more rollers or other winding device, which is or are, for example, electrically insulating and compatible with microwave exposure, or jaws and/or one or more combs.

The treatment device may be configured to allow the use of a plurality of different devices for applying stress, which serve, for example, to curl the hair or, conversely, to smooth it out. The devices may be interchangeable by the user.

The treatment device may be equipped to recognize automatically the stress application device in use, where appropriate, by virtue for example of electrical contacts or of one or more interrupters.

The device for applying mechanical tension may be configured so as to place the treated hair flat during microwave exposure.

Whatever the embodiments under consideration, the hair treated in step a) may be subjected to one or to a plurality of mechanical stresses. The mechanical stress or stresses may be selected from flexing, restoring, compressive, torsional and/or tensile stresses. The stresses applied may be aimed at curling the hair or, conversely, at smoothing it out. The stresses applied may also be aimed at curling the hair over a portion of its length and smoothing it out over another portion of its length.

The treatment device may comprise, within a single hand-held article, the microwave generator and the device for applying mechanical tension. By "hand-held article" is meant an article which is manipulated by the user with one hand during the treatment of the hair.

When the treatment device comprises a tongs, the microwaves may be emitted by only one of the branches of the tongs, or by all of the branches of the tongs.

Forwarding means which can be used to forward the microwaves from the generator to the enclosure include wave guides, for example a flexible coaxial cable with a length of less than 10 m, preferably less than 5 m, and a diameter of less than 5 cm, preferably less than 2 cm, and assemblies comprising at least one antenna which emits electromagnetic radiation and at least one antenna which receives electromagnetic radiation.

The microwave generator and/or the enclosure may be configured so as to subject the hair treated during step b) to microwave radiation which is variable in its spatial distribution within the enclosure—rotating, for example. Rotating microwave radiation may advantageously allow the treated hair to be exposed more uniformly to said radiation, and thus reduce the risk of local overexposure to the radiation.

The solvent is, for example, a liquid having a boiling point of less than 200° C.

The liquid may preferably comprise, in particular consist of, a polar protic liquid medium having a dielectric constant at 20° C. which is greater than or equal to 8, better 10, better 15.

This solvent preferably comprises water and/or propanol. More preferably, this solvent is water or propanol.

In one embodiment, the solvent in vapour form may be generated by direct heating of the solvent in the liquid state by the microwaves.

The solvent in vapour form may have, in the vicinity of and/or in contact with the hair, in step b), a temperature of between 80 and 200° C., preferably between 100 and 150° C., for example between 120 and 150° C.

The pressure to which the treated hair is subject in step b) may be between $10^5$ and $10^6$ Pa (1-10 bar), preferably between $10^5$ and $5\times10^5$ Pa (1-5 bar).

The hair may, during part or totality of step b), be present in a volume defined by at least a wall of a material, said material allowing microwaves to pass through it and limiting the evaporation of the compound present, before emission of the microwaves, in contact with the treated hair.

The use of such material may advantageously reduce the drying of the hair during the treatment according to the invention.

The material may comprise, in particular consist of, cellophane and/or may have a low porosity. In a variant, the material may be porous and in particular be a mesh.

The material may keep its physical structure after the exposition to the microwaves. In particular, the material may not melt after the exposition to the microwaves.

The method according to the invention may further comprise at least one step c) which involves applying to the hair at least one durable shaping composition.

By "durable shaping composition" is meant a composition which, when applied to the hair, allows the disulphide bonds present within the keratin to be open.

This step may take place before step a) and/or after step b).

Steps a) and b) may reinforce the action of the shaping composition, and may allow, for example, the amount of active agents to be reduced or the efficacy thereof to be enhanced for the same amount.

The method according to the invention may further comprise at least one step d), after step c), which involves applying to the hair at least one fixing composition.

By "fixing composition" is meant a composition which, when applied to the hair, allows the disulphide bonds present within the keratin to be reconstituted and therefore contributes to the holding of the hairstyle in the shape desired. The fixing composition may also make it possible to enhance the retention of the shape obtained by the action of the shaping composition.

This step d) may take place before step a) and/or after step b), while remaining after step c).

The duration of step b) may vary depending on the shaping performance desired and on the nature of the hair, for example.

Irrespective of the exemplary embodiments under consideration, the duration of step b) may be between 1 s and 30 min, preferably, between 1 s and 10 min.

Irrespective of the exemplary embodiments under consideration, step b) may be repeated, for example, between 0 and 10 times, preferably between 0 and 5 times.

The shaping or fixing compositions may be applied when the hair is present in the enclosure, by virtue, for example, of an appropriate application system. The application system comprises, for example, a pad, a comb, one or more distribution holes or an atomizing nozzle, disposed within the enclosure or on its outside, for example on the path of the hair emerging from or entering the enclosure.

The shaping composition and/or the fixing composition may be subjected, where appropriate, to the microwave radiation.

The treatment device may comprise a sensor which is sensitive to a characteristic of the hair—for example the colour, the mechanical strength, the surface condition and/or the moistness—and the treatment device may control at least one parameter of the treatment in dependence on the characteristic thus detected, for example the microwave energy, the temperature of the solvent, the duration of the treatment and/or the mechanical stress exerted.

According to another of its aspects, the invention relates to a hair treatment device for implementing the method as defined above, comprising:

a device for applying mechanical tension to the hair, a microwave generator.

All of the features specified with regard to the method above apply to the treatment device.

Accordingly, the treatment device may, for example, define a treatment enclosure which forms a microwave screen.

DESCRIPTION OF THE FIGURES

The invention may be better comprehended from a reading of the detailed description below, of non-limitative examples for its implementation, and from examination of the attached drawing, in which:

FIGS. 1 to 5 represent, schematically and partially, exemplary embodiments of treatment devices according to the invention, FIG. 10 represents, schematically and partially, an exemplary embodiment according to the invention, and FIGS. 6 to 9 represent locks of hair which have undergone various cosmetic treatments.

FIG. 1 shows a treatment device 100 comprising a handpiece 3 comprising an enclosure in which the hair to be treated is received, connected by a flex 2 to a base unit 1 comprising a microwave generator.

Figure 8:
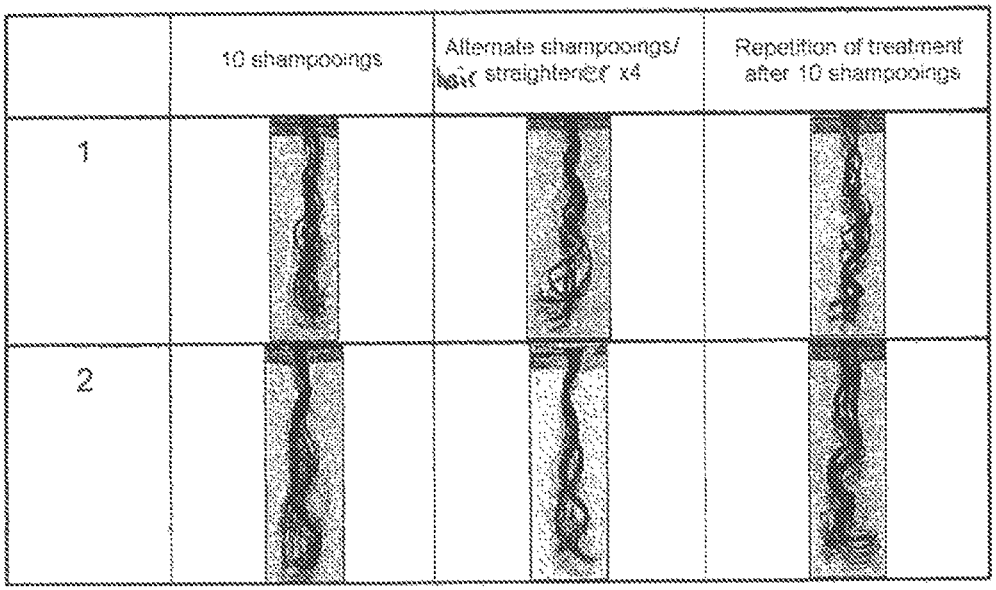

The flex 2 may comprise a waveguide.

FIG. 2 shows a detail of FIG. 1.

The microwaves 70 forwarded within the handpiece 3 by the waveguide 2 permit heating of the liquid solvent present on the hair to be treated and allows it to be transformed into the state of solvent in vapour form. In this exemplary embodiment, a device for applying mechanical tension and a lock of hair (not shown) are present within the handpiece 3, and the hair is exposed both to the microwaves and to the solvent in vapour form 80. A temperature detector 150 may be present in order to measure the temperature of the treated lock of hair, and a control system, for example a microprocessor control system, may allow the emission of the microwaves to be interrupted or modified in the event that a temperature is detected which is above a predetermined threshold.

FIG. 3 shows an exemplary embodiment in which the treatment enclosure is formed by closing a tongs forming all or part of the handpiece 3. The tongs, when open, allow one or more locks of hair for treatment to be introduced between the branches. Each branch defines, for example, half of the enclosure.

The microwaves may be emitted by a single branch or by both branches of the tongs.

A sensor (not shown) may inform the treatment device that the tongs are closed, and the transmission of the microwaves may be conditioned to the detection of this closing.

The mechanical tension applied to the hair may be a tensile force, in order to smooth out the hair.

In all of the examples above, the means of forwarding the microwaves may comprise an emitting antenna 10 and a receiving antenna 15, as illustrated in FIG. 4.

FIG. 5 also shows a lock of hair M which is present in a treatment enclosure of the handpiece 3. The enclosure is impervious to microwaves and for this purpose, for example, comprises joints of electrically conductive foam 200 which reflects the microwave radiation at the point at which the hair leaves the enclosure.

In one variant, not shown, the microwave generator 1 may be present, for example, within the chamber and/or within the device for applying mechanical tension.

FIG. 10 shows an embodiment according to the invention wherein a lock of hair M is present in a volume defined by a wall 300 of a material, said material allowing microwaves 70 to pass through it and containing the vapour 80 generated.

The containing of the vapour 80 advantageously allow the hair M to be moistened during the treatment.

Said material may comprise, in particular consist of, cellophane and/or have a low porosity. In a variant, the material may be porous and in particular be a mesh.

Shaping Composition

Reducing Composition

Reducing Agents

The shaping composition may be a reducing composition comprising one or more reducing agents.

The reducing agent may for example be selected from:

thioglycolic acid of formula (1):

$$HS—CH_2—COOH \quad (1),$$

thiolactic acid of formula (2):

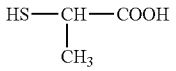

3-mercaptopropionic acid of formula (3):

$$HS—CH_2—CH_2—COOH \quad (3),$$

cysteamine of formula (4):

$$HS—CH_2—CH_2—NH_2 \quad (4),$$

cysteine of formula (5):

$$HS—CH_2—CH(NH_2)—CO_2H$$

and also their salts and their esters, phosphines, sulphites and borohydrides.

The cosmetically acceptable salts of the products (1) to (4) above include, for example, the ammonium salts, primary, secondary or tertiary amine salts and alkaline earth metal salts. Primary, secondary or tertiary amine salts include, respectively, monoethanolamine, diisopropanolamine and triethanolamine.

The esters of the compounds (1) to (4) above include glycerol monothioglycolate, ethylene glycol monothioglycolate, the azeotropic mixture of 2-hydroxypropyl thioglycolate and 2-hydroxy-1-methylethyl thioglycolate described in patent application FR-A-2 679 448, glycerol monothiolactate, ethylene glycol monothiolactate, glycerol 3-mercaptopropionate and ethylene glycol 3-mercaptopropionate.

The reducing agent or agents may be present in an amount of, for example, between 0.01% and 20%, preferably between 0.1% and 10%, more preferably between 0.3% and 3% by weight, relative to the total weight of the reducing composition.

Additives Present within the Reducing Composition

The reducing composition may further comprise one or more additives.

The additives may be used, within the reducing composition, alone or in mixtures.

The reducing composition may comprise at least one surfactant, for example a nonionic, anionic, cationic or amphoteric surfactant, among which mention may be made of alkyl sulphates, alkylbenzene sulphates, alkyl ether sulphates, alkylsulphonates, quaternary ammonium salts, alkylbetaines, ethoxylated alkylphenols, fatty acid alkanolamides, ethoxylated fatty acid esters, and other nonionic surfactants of hydroxypropyl ether and alkylpolyglycoside type.

The surfactant or surfactants may for example be present in an amount of less than 30% by weight, and preferably of between 0.5% and 10% by weight, relative to the total weight of the reducing composition.

With the aim of enhancing the cosmetic properties of the hair or else of reducing or preventing damage to the hair, the reducing composition may further comprise at least one cationic, anionic, nonionic or amphoteric treating agent.

The particularly preferred treating agents include especially those described in French patent applications FR 2 598 613 and FR 2 470 596. As treating agents it is also possible to use volatile or non-volatile, linear or cyclic silicones and mixtures thereof, polydimethylsiloxanes, quaternized polyorganosiloxanes such as those described in French patent application FR 2 535 730, polyorganosiloxanes containing aminoalkyl groups modified with alkoxycarbonylalkyl groups, such as those described in patent U.S. Pat. No. 4,749,732, polyorganosiloxanes such as the polydimethylsiloxane-polyoxyalkyl copolymer of Dimethicone Copolyol type, a polydimethylsiloxane containing stearoxy (stearoxydimethicone) end groups, a polydimethylsiloxane-dialkylammonium acetate copolymer or a polydimethylsiloxane-polyalkylbetaine copolymer, these copolymers being described in British patent application GB 2 197 352, polysiloxanes organically modified with mercapto or mercaptoalkyl groups, such as those described in French patent FR 1 530 369 and in European patent application EP 295 780, and also silanes such as stearoxytrimethylsilane.

The reducing composition may further comprise other treating agents, for example cationic polymers such as those used in the compositions of French patents FR 2 472 382 and FR 2 495 931, or else cationic polymers of the ionene type such as those used in the compositions of Luxembourg patent 83703. The composition may also comprise basic amino acids, for example lysine or arginine, or acids, for example glutamic acid or aspartic acid, peptides and their derivatives, protein hydrolysates, waxes, swelling agents and penetrants, or agents reinforcing the efficacy of the reducing agent, such as an $SiO_2$/PDMS (polydimethylsiloxane) mixture, dimethylisosorbitol, urea and its derivatives, pyrrolidone, N-alkylpyrrolidones, solvents such as alkylene glycol or dialkylene glycol alkyl ethers such as, for example, propylene glycol monomethyl ether, dipropylene glycol monomethyl ether, ethylene glycol monoethyl ether and diethylene glycol monoethyl ether, $C_3$-$C_6$ alkanediols such as, for example, 1,2-propanediol and 1,2-butanediol, 2-imidazolidinone, and other compounds such as fatty alcohols, lanolin derivatives, active ingredients such as pantothenic acid, agents for counteracting hair loss, anti-dandruff agents, thickeners, suspension agents, sequestrants, opacifiers, dyes, sunscreen agents, and also fragrances and preservatives.

The pH of the reducing compositions is preferably between 6 and 11, more preferably between 7 and 10.

The reducing composition may comprise at least one alkalifying agent for adjusting the pH.

The alkalifying agent, preferably, used in the compositions according to the invention is an agent which may allow the pH of the composition or compositions in which it is present to be increased.

The alkalifying agent may be a Bronsted, Lowry or Lewis base.

The alkalifying agent may be organic or inorganic.

The alkalifying agent may for example be selected from:

a) aqueous ammonia, b) alkanolamines such as mono-, di- and triethanolamines and also their derivatives, c) ethoxylated and/or propoxylated ethylenediamines, d) alkali metal silicates such as sodium metasilicates, e) amino acids, preferably basic amino acids, such as arginine, lysine, ornithine, citrulline and histidine, f) (bi)carbonates, particularly primary, secondary or tertiary amine (ammonium), alkali metal or alkaline earth metal (bi)carbonates, and g) compounds of formula (II) below:

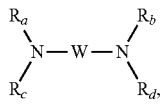

(II)

in which W is a propylene residue which is optionally substituted by a hydroxyl group, or a $C_1$-$C_4$ alkyl radical. The groups $R_a$, $R_b$, $R_c$ and $R_d$ are identical or different and may be a hydrogen atom or a $C_1$-$C_4$ alkyl or $C_1$-$C_4$ hydroxyalkyl radical.

Preferred alkalifying agents may be aqueous ammonia and monoethanolamine.

The alkalifying agent or agents, for example as defined above, may be present in an amount of between preferably 0.001% and 10%, for example between 0.005% and 8%, by weight, relative to the weight of the reducing composition. This concentration may in particular be a function of the desired pH of the reducing composition.

Conditions of Application of the Reducing Composition

In one preferred exemplary embodiment, when it is applied before step a) and/or after step b), the reducing composition may be left to act, for example, for a duration of between 1 and 50 minutes, preferably between 1 and 30 minutes.

When the reducing composition is applied before step a) and/or after step b), the shaping step may take place at a temperature of between 20 and 40° C., preferably between 25 and 35° C.

Moreover, the reducing composition may, preferably, be applied to wet and clean hair fibres.

Composition Comprising a Hydroxide Compound

The shaping composition may comprise one or more hydroxide compounds.

Hydroxide Compound

By "hydroxide compound" is meant a compound which is capable of releasing hydroxide ions. In the shaping composition used in the context of the invention, it is possible to use all of the hydroxide compounds that are commonly used in lanthionization processes.

The at least one hydroxide compound may preferably be selected from alkali metal hydroxides, alkaline earth metal hydroxides, transition metal hydroxides, hydroxides of lanthanide metals, hydroxides of actinide metals, hydroxides of metals from group III, hydroxides of metals from group IV, hydroxides of metals from group V, hydroxides of metals from group VI, organic hydroxides, and compounds comprising at least one partially hydrolysable hydroxide substituent.

Hydroxide compounds which can be used in the context of the present invention may include, for example, sodium hydroxide, guanidinium hydroxide, lithium hydroxide, calcium hydroxide, barium hydroxide, magnesium hydroxide, aluminium hydroxide, copper hydroxide, strontium hydroxide, molybdenum hydroxide, manganese hydroxide, zinc hydroxide and cobalt hydroxide.

The preferred hydroxide compounds are sodium hydroxide and guanidinium hydroxide. Their concentration is preferably such that the pH of the composition is between 12 and 14.

The hydroxide compound or compounds may be present in the shaping composition at a concentration of between 0.2 and 1 M, preferably between 0.4 and 0.6 M.

Emulsifiers

The shaping composition comprising a hydroxide compound may be at least partly in the form of an emulsion, preferably an oil-in-water or water-in-oil emulsion.

In the latter case, it may comprise at least one nonionic, anionic, cationic or amphoteric emulsifier.

The emulsifiers are surfactants and are selected according to the emulsion to be obtained, for example water-in-oil (W/O) or oil-in-water (O/W) emulsion.

When the aim is to obtain a shaping composition which comprises an emulsion, for example, as described above, use may be made of:

amphoteric emulsifiers, for example N-acylamino acids such as N-alkylaminoacetates and disodium cocoamphodiacetate, and amine oxides such as stearamine oxide, anionic emulsifiers, for example acylglutamates such as disodium hydrogenated tallow glutamate (Amisoft HS-21® sold by Ajinomoto), carboxylic acids and their salts such as sodium stearate, phosphoric esters and their salts such as DEA oleth-10 phosphate, sulphosuccinates such as disodium PEG-5 citrate lauryl sulphosuccinate and disodium ricinoleamido MEA sulphosuccinate, cationic emulsifiers, for example alkylimidazolidiniums such as isostearyl-ethylimidonium ethosulphate, and ammonium salts such as N,N,N-trimethyl-1-docosanaminium chloride (behentrimonium chloride), and nonionic emulsifiers, for example the esters and ethers of saccharides such as sucrose stearate, sucrose cocoate, and the mixture of sorbitan stearate and sucrose cocoate sold by ICI under the name Arlatone 2121®, polyol esters, for example glycerol esters or sorbitol esters, such as glyceryl stearate, polyglyceryl-2 stearate, sorbitan stearate, glycerol ethers, ethoxylated and/or propoxylated ethers, such as the ethoxylated and propoxylated ether of lauryl alcohol containing 25 ethoxy groups and 25 propoxy groups (CTFA name "PPG-25 laureth-25"), and the ethoxylated ether of the mixture of C12-C15 fatty alcohols containing 7 ethoxy groups (CTFA name "C12-C15 Pareth-7"), polymers of ethylene glycol, such as PEG-100, and mixtures thereof.

It is possible to use one or more of these emulsifiers.

For the water-in-oil (W/O) emulsions, examples of emulsifiers include polyol fatty esters, in particular fatty esters of glycerol or of sorbitol, and especially isostearyl, oleyl and ricinoleyl esters of a polyol, such as the mixture of petrolatum, polyglyceryl-3 oleate, glyceryl isostearate, hydrogenated castor oil and ozokerite that is sold under the name Protegin W® by Goldschmidt, sorbitan isostearate, polyglyceryl diisostearate, polyglyceryl-2 sesquiisostearate; esters and ethers of saccharides such as methylglucose dioleate; fatty esters such as magnesium lanolate; dimethicone copolyols and alkyl dimethicone copolyols, such as the laurylmethicone copolyol sold under the name Dow Corning 5200 Formulation Aid by Dow Corning, the cetyldimethicone copolyol sold under the name Abil EM 90® by Goldschmidt, and dimethicone copolyol; and mixtures thereof.

The oils of the emulsions may be vegetable oils, mineral oils, silicone oils, liquid esters or linear or branched $C_7$-$C_{16}$ hydrocarbons.

Conditions of Application of the Composition Comprising a Hydroxide Compound

In one preferred exemplary embodiment, when it is applied before step a) and/or after step b), the composition comprising a hydroxide compound is left to act for example for a duration of between 5 and 60 minutes, preferably between 10 and 20 minutes.

When the composition comprising a hydroxide compound is applied before step a) and/or after step b), the fixing step may take place at a temperature of between 20 and 40° C., preferably between 25 and 35° C.

After the step of applying the composition comprising a hydroxide compound, and after any contact time, the hair may be rinsed, preferably with running water and with osomosed water, or even with an acidic composition in order to remove the residues of alkalinity.

Acidic Composition

By "acidic composition" is meant a composition comprising one or more acids selected, for example, from acids containing one or more carboxylic, sulphonic, phosphonic or phosphoric acid functions.

The acids may contain other chemical functions, more particularly hydroxyl or amino functions.

The acids may be saturated or unsaturated.

Acids which can be used may include, for example, acetic acid, propanoic acid, butanoic acid, lactic acid, glycolic acid, ascorbic acid, maleic acid, phthalic acid, succinic acid, taurine and citric acid.

One preferred acid is citric acid.

The inorganic acid or acids present in the composition may be selected from monoacidic acids or polyacids.

They include, for example, hydrochloric acid, orthophosphoric acid, sulphuric acid and boric acid.

The acidic composition may for example have a pH of between 2 and 7, preferably between 3 and 4.

Oxidizing Composition

The fixing composition is an oxidizing composition.

By "oxidizing composition" is meant compositions comprising, for example, one or more oxidizing agents selected for example from hydrogen peroxide, urea peroxide, alkali metal bromates, polythionates, and persalts, such as perborates, percarbonates and persulphates.

The oxidizing agent is preferably hydrogen peroxide.

The oxidizing agent or agents may be present in an amount of between 0.1% and 10%, preferably between 0.5% and 5%, by weight, relative to the total weight of the oxidizing composition.

Preferably, when the oxidizing agent is hydrogen peroxide in aqueous solution, the oxidizing composition used in the method according to the invention comprises at least one hydrogen peroxide stabilizer.

Such stabilizers may include, for example, alkali metal or alkaline earth metal pyrophosphates, such as tetrasodium pyrophosphate, alkali metal or alkaline earth metal stannates, phenacetin or salts of acids with oxyquinoline, such as oxyquinoline sulphate. Even more advantageously, at least one stannate is used alone or in combination with at least one pyrophosphate.

The hydrogen peroxide stabilizer or stabilizers may be present in an amount of between 0.0001% and 5%, preferably between 0.01% and 2%, by weight relative to the total weight of the oxidizing composition.

The oxidizing composition may for example have a pH of between 1.5 and 4.5, preferably between 2 and 3.5, especially when the oxidizing agent is hydrogen peroxide.

In one preferred exemplary embodiment, when it is applied before step a) or after step b), the oxidizing composition as defined above is left to act for approximately 2 to 30 minutes, preferably for 2 to 15 minutes, more particularly between 2 to 7 minutes at a temperature of between 20 and 40° C., preferably between 25 and 35° C. The oxidizing composition is preferably applied to clean and wet hair.

The vehicle of the reducing and oxidizing compositions is preferably an aqueous medium composed of water and may advantageously contain cosmetically acceptable organic solvents, including, more particularly, alcohols such as ethyl alcohol, isopropyl alcohol, benzyl alcohol, and phenylethyl alcohol, or polyols or polyol ethers such as, for example, ethylene glycol monomethyl, monoethyl and monobutyl ethers, propylene glycol or its ethers such as, for example, propylene glycol monomethyl ether, butylene glycol, dipropylene glycol, and also diethylene glycol alkyl ethers such as, for example, diethylene glycol monoethyl ether or monobutyl ether. The organic solvents may in this case be present at concentrations of between approximately 0.1% and 20% and preferably between approximately 1% and 10% by weight, relative to the total weight of the composition.

The pH of the oxidizing composition in the method according to the invention may be obtained and/or adjusted conventionally by addition either of one or more alkaline agents, such as those already mentioned in the reducing composition, or of acidifying agents such as, for example, hydrochloric acid, acetic acid, lactic acid, boric acid, citric acid and phosphoric acid.

All of the compositions used in the method according to the invention may be present independently of one another in the form of a thickened or non-thickened lotion, a cream, a gel or a mousse.

The examples which follow are given for purposes of illustration and have no limitative effect on the present invention.

EXAMPLES

Example 1: Method for Durably Curling the Hair

A dry lock of hair which is then moistened and shampooed is placed under mechanical stress, for example by being wound around a roller with a diameter of less than 3 cm with the two ends held fixed.

The assembly is placed in an enclosure. The power and the duration of the microwave treatment are variable according to the intensity of curling which is desired.

A final shampooing or a rinsing may optionally be performed.

If the lock is dried entirely, the desired curling is not observed.

Example 2: Method for Smoothing the Hair

A dry lock of hair, which is then moistened or shampooed, is stretched along a support with a length of between 1 and 20 cm, with the two ends held fixed.

The assembly is then placed in an enclosure. The power and the duration of the microwave treatment are variable depending on the intensity of the smoothing that is desired.

A final shampooing or a rinsing may optionally be performed.

As a variant, the dry lock of hair, which is then moistened or shampooed, is placed directly between the jaws of an enclosure formed by a tongs.

The mechanical tension is then obtained by pincering and by pulling the lock.

Example 3

The lock of hair is pretreated, before the application of the microwaves, with a dyeing (by oxidation or direct) composition, a bleaching composition, a permanent wave, based for example on thiol reducing agents, a sodium hydroxide or guanidine hair straightening procedure, a care treatment, a hair mask or a shampoo, and then is curled as described in Example 1 or smoothed as described in Example 2.

Example 4: Method for Durably Curling or Smoothing the Hair, Employing a Shaping Composition The lock of hair, optionally shampooed, and wet or dry, is first of all impregnated with a shaping composition, with a mass bath ratio of 10 to 1.

The resulting lock of hair is subsequently placed under mechanical stress. If the aim is to carry out a curling procedure, said lock is, for example, wound around a roller with a diameter of less than 3 cm, with the two ends held fixed.

If the aim is to carry out a smoothing procedure, said lock of hair is stretched along a support with a length of between 1 and 20 cm, with the two ends held fixed.

The assemblies thus obtained are placed in an enclosure. The power and the duration of the microwave treatment are variable depending on the intensity of the curling or smoothing that is desired.

The lock of hair may subsequently be rinsed or shampooed on the support or else may be detached from the support.

When the shaping composition comprises a reducing composition and when the lock of hair is not detached from the support, a fixing step comprising a step of applying an oxidizing composition may be carried out.

As a variant, when the shaping composition comprises a composition comprising a hydroxide compound and when the lock is detached from the support, a fixing step comprising a step of applying an acidic composition may be carried out.

A final shampooing or a rinsing may optionally be performed.

Example 5: Method for Durably Curling or Smoothing the Hair, Employing an Oxidizing Composition A lock of hair, optionally shampooed and wet, is treated, with a mass bath ratio of 10 to 1, with a shaping composition comprising a reducing composition. The shaping composition may be left to act for a variable time, depending on the desired performance.

The lock is subsequently rinsed and then impregnated with an oxidizing composition, with a bath ratio of 10 to 1.

The lock of hair is placed under mechanical stress.

If the aim is to carry out curling, said lock is, for example, wound around a roller with a diameter of less than 3 cm, with the two ends held fixed.

If the aim is to carry out smoothing, said lock is stretched along a support with a length of between 1 and 20 cm, with the two ends held fixed.

The assemblies thus obtained are placed immediately in an enclosure. The power and the duration of the microwave treatment are variable depending on the intensity of the curling or smoothing that is desired.

The lock thus treated may be rinsed or shampooed on the support or else may be detached from the support.

Example 6: Method for Durably Curling or Smoothing the Hair with a One-Step Pretreatment A lock of hair, optionally shampooed and wet, is treated, with a bath ratio of 10 to 1, with a shaping composition comprising a reducing composition, for a time which is variable depending on the desired performance.

The lock of hair is then rinsed, then optionally dried, and placed under mechanical stress.

If the aim is to carry out curling, said lock is, for example, wound around a roller with a diameter of less than 3 cm, with the two ends held fixed.

If the aim is to carry out smoothing, said lock is stretched along a support with a length of between 1 and 20 cm, with the two ends held fixed.

The assemblies thus obtained are placed in an enclosure. The power and the duration of the microwave treatment are variable depending on the intensity of the curling or smoothing that is desired.

The lock thus treated may be rinsed or shampooed on the support or else may be detached from the support.

When the shaping composition comprises a reducing composition and when the lock of hair is not detached from the support, a fixing step comprising a step of applying an oxidizing composition may be carried out.

As a variant, when the shaping composition comprises a composition comprising a hydroxide compound and when the lock is detached from the support, a fixing step comprising a step of applying an acidic composition may be carried out.

A final shampooing or a rinsing may optionally be performed.

Example 7: Method for Durably Curling or Smoothing the Hair, Comprising a Shaping Step and a Fixing Step, after the Treatment in the Enclosure The lock of hair, optionally shampooed, wet or dry, is placed under mechanical stress.

If the aim is to carry out curling, said lock is, for example, wound around a roller with a diameter of less than 3 cm, with the two ends held fixed.

If the aim is to carry out smoothing, said lock is stretched along a support with a length of between 1 and 20 cm, with the two ends held fixed.

The assemblies thus obtained are placed in an enclosure. The power and the duration of the microwave treatment are variable depending on the intensity of the curling or smoothing that is desired.

A final shampooing or a rinsing may optionally be performed.

The lock, still placed on the support, is then treated with a shaping composition, with a bath ratio of 10 to 1, for a time which is variable depending on the desired performance, and then is rinsed.

When the shaping composition comprises a reducing compound and when the lock of hair is not detached from the support, a fixing step comprising a step of applying an oxidizing composition may be carried out.

As a variant, when the shaping composition comprises a hydroxide compound and when the lock is detached from the support, a fixing step comprising a step of applying an acidic composition may be carried out.

A final shampooing or a rinsing may optionally be performed.

In a variant of Examples 4 to 8, instead of being stretched along a support for smoothing, the lock of hair is placed between the jaws of the enclosure defined by a tongs. The mechanical tension is obtained by pincering and by pulling the lock.

Example 8

The lock of hair may be treated, before the method according to the invention and the optional pretreatments, with a dyeing (by oxidation or direct), bleaching, care, hair mask or shampooing treatment, and then curled or smoothed according to the procedures described in Examples 4 to 7 above.

Example 9 (Comparative)

Locks of stiff natural hair, of 0.35 g and 15 cm, which were wetted, were treated in two different ways.

Treatment according to the invention with heating of water by microwaves according to Example 1

| Lock No. | Microwave power | Exposure time | Temperature (° C.) | Pressure (bar) |
|---|---|---|---|---|
| 1 | 135 | 2 times 5 min | 145 | 4 |
| 2 | 135 | 3 times 5 min | 145 | 4 |
| 3 | 135 | 6 times 5 min | 145 | 4 |

Treatment with a thioglycolic acid permanent wave treatment, Dulcia Vital 2 Force 1, for 15 minutes, followed by a fixing step with a duration of 5 minutes with the fixative Dulcia Vital 2 (No. 4).

After these treatments, the locks were rinsed.

FIG. 6 shows locks 1 to 4 after rinsing.

Locks 1 to 4 were subsequently shampooed 5 times. The results are shown in FIG. 7.

It is observed that the shaping performance on locks 1, 2 and 3 is better than on those treated with the permanent wave treatment (lock 4).

Example 10 (Comparative)

Locks of stiff natural hair, of 0.35 g and 15 cm, which were wetted, were treated in two different ways.

Treatment according to the invention with heating of water by microwaves according to Example 1 (No. 1):

| Power (W) | Exposure time | Temperature (° C.) | Pressure (bar) |
|---|---|---|---|
| 135 | 6 times 5 min | 145 | 4 |

Treatment with a thioglycolic acid permanent wave treatment, Dulcia Vital 2 Force 1, for 15 minutes, followed by a fixing step with a duration of 5 minutes with the fixative Dulcia Vital 2 (No. 2).

After these treatments, the locks were rinsed and underwent various strength tests: effect of ten standard shampooings, effect of four alternating shampooings/straightening cycles, effect of four shampooing/straightening cycles followed by ten shampooings. The results are shown in FIG. 8.

It is observed that lock No. 1 exhibits better strength following the various tests than lock No. 2.

Example 11 (Comparative)

Locks of curly natural hair, of 0.35 g and 15 cm, which were wetted, were treated in two different ways.

Treatment according to the invention with heating of water by microwaves according to Example 2 (No. 1):

| Power (W) | Exposure time | Temperature (° C.) | Pressure (bar) |
|---|---|---|---|
| 135 | 6 times 5 min | 145 | 4 |

Figure 9:
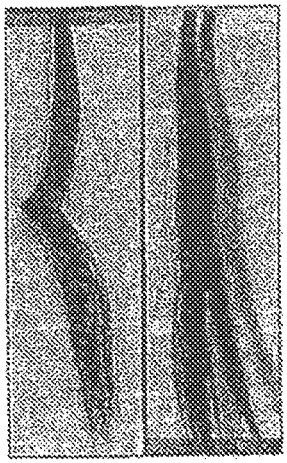

Thioglycolic acid smoothing with the smoothing product X-Tenso for 20 min, followed by 10 min of fixing with the neutralizing fixative milk X-Tenso (No. 2). After these treatments, the locks were rinsed and shampooed. The results are shown in FIG. 9.

It is observed that, with the invention, smoothing performances are obtained that are identical to the state of the art, without the use of reducing agent and oxidizing agent.

Example 12

Locks of stiff natural Caucasian hair, of 0.35 g and 15 cm, were treated in two ways.

Treatment according to the invention according to Example 4:

Shaping composition: 0.5 M aqueous solution of thioglycolic acid

Production of curls (locks on rollers)

Microwave/vapour treatment: P=135 W; T=145° C.; p=4 bar; duration of exposure: 5 min Rinsing of the locks on rollers 5 min of fixing with an oxidizing composition Final shampooing Comparative Shaping composition: 1 M aqueous solution of thioglycolic acid Production of curls (locks on rollers)

20 min of waiting at 25° C.

Rinsing of the locks on rollers 5 min of fixing with an oxidizing composition

Final shampooing

The microwave/vapour treatment produces a shaping result which is identical to the state of the art, with a reduced concentration of thioglycolic acid.

Owing to the reduced concentration and to the shorter treatment time, the lock is less damaged and the feel is more cosmetic.

Example 13

Locks of curly natural African hair, of 0.35 g and 15 cm, were treated in two ways:

Treatment of the invention according to Example 4:

Shaping composition: 0.3 M aqueous sodium hydroxide solution

Hair straightening (locks stretched along a support)

Microwave/vapour treatment: P=135 W; T=145° C.; p=4 bar; duration of exposure: 5 min Shampooing with an acidic composition Comparative Shaping composition: 0.6 M aqueous sodium hydroxide solution Hair straightening (locks worked with the hand)

20 min of waiting at 25° C.

Shampooing with an acid composition

The microwave/vapour treatment produces a straightening result which is identical to the state of the art, with a reduced concentration of sodium hydroxide.

Owing to the reduced concentration and to the shorter treatment time, the lock is less damaged and the feel is more cosmetic.

The expression "comprising a/one" should be understood as "comprising at least one".

The expression "of between" should be understood with the end points included.

The invention claimed is:

1. A cosmetic hair treatment method comprising:

a) applying a mechanical tension to the hair to be treated, b) exposing the hair under the mechanical tension to microwaves, while contacting the hair with a solvent vapour, without complete drying of the hair during the microwave exposure, to obtain the treated hair;

wherein the solvent vapour is generated by evaporation of a solvent which is in contact with the hair to be treated before the exposure to the microwaves, the solvent vapour having, in the vicinity of and/or in contact with the hair, in step b), a temperature of between 100 and 150° C.; and after step b) the hair retains at least 5% of the weight of liquid compounds present before step b), in contact therewith, the liquid compound adding to natural moisture of the hair before treatment, and wherein a frequency of the microwaves is between 500 MHz and 10 GHz, the method further comprising c) applying to the treated hair at least one composition for durable shaping of the hair, the composition being a reducing composition comprising one or more reducing agents, the pH of the reducing composition being between 7 and 11, the reducing composition comprising at least one alkalifying agent, the alkalifying agent being selected from:

aqueous ammonia, alkanolamines and derivatives thereof, ethoxylated and/or propoxylated ethylenediamines, alkali metal silicates, amino acids, compounds of formula (II):

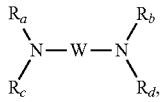

wherein

W is a propylene residue which is optionally substituted by a hydroxyl group, or a C1-C4 alkyl radical, and Ra, Rb, Rc and Rd are identical or different and may be a hydrogen atom or a C1-C4 alkyl or C1-C4 hydroxyalkyl radical.

2. The method according to claim 1, wherein a) and b) are successive or simultaneous.

3. The method according to claim 1, wherein the at least one composition for durable shaping of the hair comprises at least one selected from the group consisting of a reducing agent, an alkali metal hydroxide and an alkaline earth metal hydroxide.

4. The method according to claim 1, wherein the shaping composition is applied to the hair before a), after b) or both before a) and after b).

5. The method according to claim 1, further comprising applying to the treated hair at least one fixing composition comprising one or more oxidizing agents.

6. The method according to claim 5, wherein the fixing composition is applied to the hair before a), after b) and after c) or after b) and after c).

7. The method according to claim 1 wherein the mechanical tension in a) comprises application to the hair to be treated of at least one selected from the group consisting of a torsional stress, a tensile stress and a compressive stress.

8. The method according to claim 1, wherein a duration of b) is between 1 s and 30 min.

9. The method according to claim 1, wherein the microwaves having a power of the microwaves is less than 500 W.

10. The method according to claim 1, wherein the solvent comprises a polar protic liquid having a dielectric constant at 20° C. greater than or equal to 8.

11. The method according to claim 1, wherein the solvent vapour comprises at least one of water and propanol.

12. The method according to claim 1 wherein b) takes place in an enclosure which is impervious to microwaves.

13. The method according to claim 1, further comprising recovering the solvent vapour during b), after b) or both during and after b).

14. The method according to claim 1, wherein during part or a total of b), the hair is in a volume defined by at least a wall of a material which allows passage of microwaves and limits evaporation of the solvent in contact with the treated hair before emission of the microwaves.

15. The method according to claim 14, wherein the material comprises cellophane.

16. The method according to claim 1, wherein the solvent vapour is entirely generated by said evaporation of said solvent which is in contact with the hair to be treated before the exposure to the microwaves.

17. The method according to claim 1, wherein the solvent vapour comprises propanol.

18. The method according to claim 1, wherein step b) is repeated between 2 and 10 times.

19. The method according to claim 1, wherein the alkalifying agent is an alkanolamine selected from the group consisting of monoethanolamine, diethanolamine and triethanolamine and derivatives thereof.

20. The method according to claim 1, wherein the alkalifying agent is an alkali metal silicate, which is a sodium metasilicate.

21. The method according to claim 1, wherein the alkalifying agent is an amino acid selected from the group consisting of arginine, lysine, ornithine, citrulline and histidine.

* * * * *